United States Patent [19]

Clark

[11] 4,228,842

[45] Oct. 21, 1980

[54] LATCH FOR FOLDING AND SWINGING DOORS

[76] Inventor: Richard J. Clark, 38582 Grandon, Livonia, Mich. 48150

[21] Appl. No.: 950,994

[22] Filed: Oct. 13, 1978

[51] Int. Cl.[3] ..... E06B 3/12

[52] U.S. Cl. ..... 160/234; 160/229 R

[58] Field of Search ..... 160/129, 130, 181, 229 R, 160/230, 233, 234, 117, 115

[56] References Cited

U.S. PATENT DOCUMENTS 1,201,656 10/1916 Walker ..... 160/230

1,667,658 4/1928 Egley ..... 160/233

*Primary Examiner*—Peter M. Caun

*Attorney, Agent, or Firm*—Hauke and Patalidis

[57] ABSTRACT

A stay or latch for holding in a shut position folding doors of the type consisting of at least a pair of panels hinged at their adjoining edges. The latch of the invention is a channel-shaped member slidably mounted on the top edge of one of the folding door panels and manually slidable along the top edge to a position straddling the hinged junction between adjacent panels such as to prevent one panel from hingedly pivoting relative to the other.

4 Claims, 7 Drawing Figures

LATCH FOR FOLDING AND SWINGING DOORS

BACKGROUND OF THE INVENTION

Doors consisting of several adjacent independent panels hingedly joined at their abutting edges have become of common use in the building industry for a multiplicity of purposes. For example, such doors, commonly referred to as bi-fold or multi-fold doors, are often used for closing off a closet opening, as foldable room partitions, and even as bathroom or bedroom doors where space is limited, sliding doors are impractical, and a conventional door is obstructive when opened. Bi-fold and multi-fold hinged doors are available in plain wood panels or with louvered panels. They are also available in different panel thicknesses, although a certain amount of standardization within the industry has apparently reduced the choice in panel thicknesses to three sizes, $1\frac{1}{8}$ in., $1\frac{1}{4}$ in. and $1\frac{3}{8}$ in.

Although foldable doors have many advantages, they are all subject to a common inconvenience. They cannot be readily locked in a closed or shut position, and when closed they may spontaneously partially open in buildings subject to vibrations, or when a door is slammed, or for any other reason. As this type of door is easily opened, children often gain unauthorized access to the contents of the closet or, while playing with the doors, folding or unfolding them, they easily get their fingers caught between the hinged panels and are injured.

The present invention provides a convenient stay or latch means for bi-fold and multi-fold doors which overcomes by simple and low cost means the inconveniences and shortcomings of this type of doors. The present invention also provides a stay or latch means securely holding two-panel swinging doors shut.

SUMMARY OF THE INVENTION

The present invention provides a stay or latch for preventing multi-panel folding or swinging doors from being opened inadvertently or accidentally, and for considerably reducing the opportunities for children playing with the doors. The latch of the invention is in the form of a simple single U-shaped channel member which, when positioned so as to straddle two adjacent panels of a multi-panel folding or swinging door at their top edges, prevents relative hinging motion of those two panels. The U-shaped channel member may be conveniently slid when desired so as to straddle the top of only one of the panels, thus permitting the panels to hingedly move in the usual manner relative to each other.

The many objects and advantages of the present invention will be readily apparent to those skilled in the art when the following specification is read in conjunction with the accompanying drawing wherein:

DETAILED DESCRIPTION OF THE PREFERRED EMBODIMENTS

Figure 1:
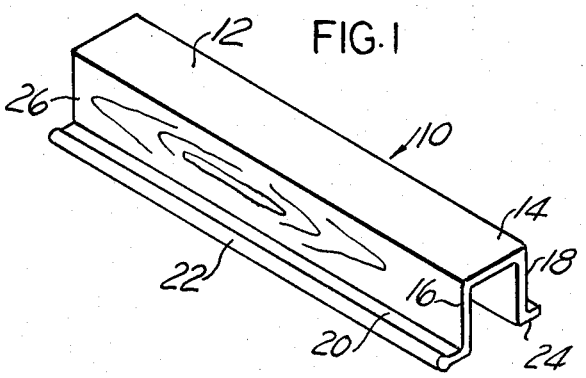
FIG. 1 is a perspective view of an example of structure for a stay or latch member made in accordance with the present invention.
Figure 2:
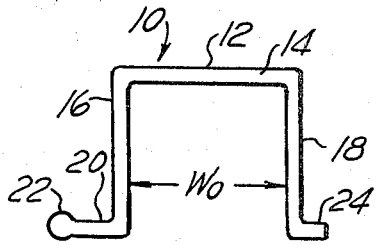
FIG. 2 is an end view thereof.

Referring now to the drawing and more particularly to FIGS. 1–2, a folding door stay or latch 10 according to the present invention takes the form of a generally U-shaped channel member 12 which is made in any convenient manner such as a sheet metal stamping, a metal casting, or a molded plastic part, but which, preferably, is made of a metallic extrusion or plastic extrusion, such as for example aluminum, polyvinyl chloride or the like, cut to length. The U-shaped channel member is provided with a bottom wall 14 and a pair of substantially parallel sidewalls 16 and 18 formed integral with the bottom wall 14 and extending in the same direction substantially at right angle to the bottom wall 14. One of the sidewalls, for example sidewall 16, is provided at its edge with an outwardly extending flange portion 20, projecting substantially at a right angle to the sidewall and preferably provided with a rounded terminal edge 22. The other sidewall, sidewall 18, is also preferably provided with an outwardly extending integral flange portion 24, which is preferably slightly shorter than the flange portion 20, as illustrated. The outside surface of the sidewalls may be left unfinished, or it may be provided with a wood grain imitation applique, as shown at 26, so as to blend with any decor or any natural wood finish panel. In the alternative, and when molded or extruded of a plastic material, the channel member 12 may be made transparent and colorless.

Figure 3:
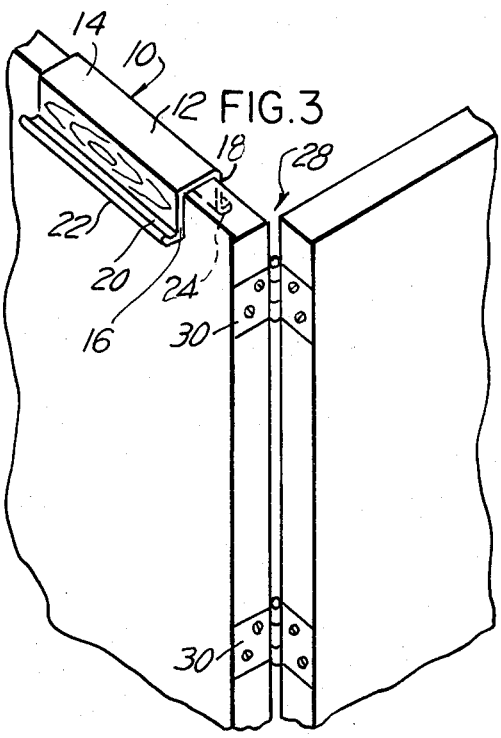
FIG. 3 is a partial perspective view of a two-panel folding door provided with a latch member in accordance with the present invention, shown with the latch member disposed such as to allow the door to fold and unfold in the usual manner.

It will be appreciated that the flange portions 20 and 24, and more particularly the flange portion 24, are not absolutely necessary, but forming the channel member 12 with the flange portions 20 and 24 greatly increases the rigidity of the sidewalls 16 and 18, respectively, against lateral deflection. In addition, the flange portion 20, whether or not provided with a rounded edge 22, forms a convenient hand grip for sliding the channel member 12 from a position whereby it straddles for example the top edge of one of the panels of a bi-fold or multi-fold door 28, FIG. 3, to a position, FIG. 4, where it straddles the top edge of two consecutive adjoining panels of the folding door 28, thus preventing the two panels interconnected by means of the hinges 30 from inadvertently pivoting one relative to the other. It is readily apparent that by placing the stay or latch 10 of the invention on the top of the hingedly interconnected adjoining panels of a bi-fold or multi-fold door, such as door 28, the channel member 10 is generally out of the reach of children standing on the floor, while it still can be reached by a normal adult for sliding away from the hinge portion of the panels to a position, such as illustrated at FIG. 3, permitting one of the door panels to hingedly pivot relative to the other.

The interior surface of the sidewalls 16 and 18 and of the bottom wall 14 of the channel member 10 may be coated with an unctuous anti-friction material, such as a silicone resin or the like, to facilitate sliding from one position to another while disposed straddling the top edge of a door panel. The distance between the inside surface of the sidewalls 16 and 18, or distance $W_o$, corresponds, with adequate clearance, to the thickness of the door panels that the stay or latch 10 of the invention is capable of securely latching as previously explained. It is readily apparent that the channel member 12 can be used with doors formed of panels having a thickness less than the width $W_o$, but that it is preferable to use a channel member of an exact size appropriate to the thickness of the door panels. Preferably, channel members 12, in the structure illustrated at FIGS. 1–2, are made in each one of the appropriate sizes permitting a substantially close fit and match with the diverse thicknesses of door panels generally available in the industry.

Figure 5:
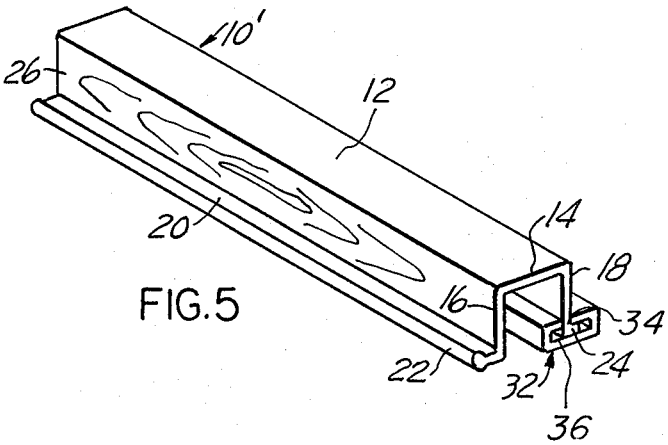
FIG. 5 is a view similar to FIG. 1 and showing a modification of a latch member made in accordance with the present invention.
Figure 6:
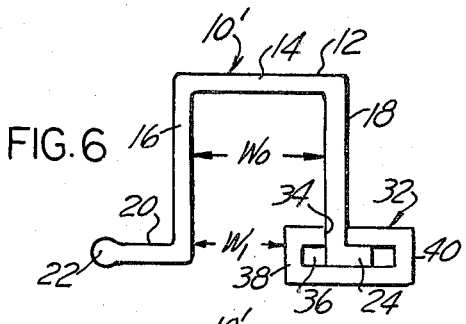
FIGS. 6 and 7 are end views of the latch member of FIG. 5 illustrating how it is adjustable in effective width to accommodate various thicknesses of door panels.
Figure 7:
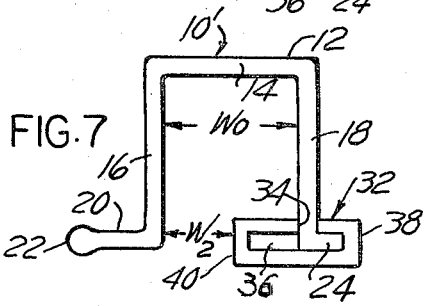

At FIGS. 5–7 there is shown a modification of the invention providing a stay or latch 10' adjustable for use with three different panel thickness sizes. For that purpose, the channel member 10 of the stay or latch 10' is formed of a molding or extrusion substantially identical to the channel member 12 of FIGS. 1–2. A rail member 32, made of the same material as the channel member 12, is slidably mounted over the end of the sidewall 18 provided with the outwardly extending side flange 24. The slidably removable rail member 32 is preferably made of a metallic or plastic extrusion cut to the same length as the channel member 12, and shaped such as to be in the form of a tubular body, rectangular in section and having a longitudinal slot 34 of a width substantially equal to the thickness of the sidewall 18. The inside of the rail member 32 forms an elongated centrally disposed cavity 36, substantially rectangular in cross-section, and of a width substantially equal to the thickness of the flange portion 24 of the sidewall 18. The longitudinal slot 34 is disposed at a predetermined distance from one of the side surfaces, for example side surface 38, of the rail member 32 which is shorter than the distance between the longitudinal slot 34 and the other side surface 40 of the rail member 32. In this manner, when the rail member 32 is disposed in the position illustrated at FIG. 6, the stay or latch 10' may be disposed such as to straddle a door panel having a thickness $W_1$. Furthermore, by slipping the rail member 32 off and turning it around end to end, and reintroducing it over the end of the wall 18 provided with the flange 24, FIG. 7, the side surface 40 of the rail member 32 is now positioned opposite the inner surface of the sidewall 16 of the channel member 12. The distance separating the rail member side surface 40 and the inner surface of the sidewall 16, or distance $W_2$, is smaller than the distance $W_1$ resulting from disposing the rail member 32 in the position illustrated at FIG. 6. The channel member 12 is thus capable of accommodating panels of three different thicknesses, namely panels of a thickness $W_o$, with the rail member 32 completely removed, panels of a thickness $W_1$ with the rail member 32 disposed as shown at FIG. 6, and panels of a thickness $W_2$ with the rail member 32 turned around and disposed as shown at FIG. 7.

Figure 4:
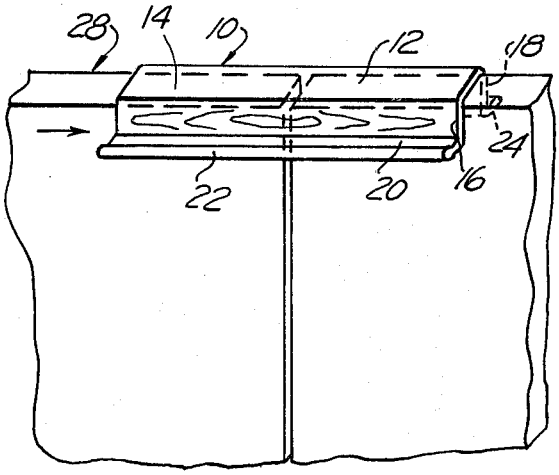
FIG. 4 is a view similar to FIG. 3 showing the latch member in position for preventing the door from folding in the usual manner.

Although the stay or latch of the invention has been described in detail and illustrated as a means for preventing the unintentional opening of doors of the folding type, it will be readily apparent that those skilled in the art that the stay or latch structure of the present invention can also be used as a convenient means for latching in a closed position the panels of a two-panel swinging door, or so-called saloon door, when disposed such as to straddle the joint between the two panels when closed, the arrangement being thus substantially as illustrated at FIG. 4. It is therefore to be understood that the expression "multi-panel door" in the appended claims is contemplated to apply to folding doors and to swinging doors.

Having thus described the present invention by way of examples of structural embodiments thereof, modifications whereof will be apparent to those skiled in the art, what is claimed as novel is as follows:

1. A latch for a multi-panel door comprising at least a pair of juxtaposed aligned panels when said door is closed, said latch comprising a U-shaped channel member slidably disposed over the top edge of one of the panels forming said door and slidable to a position straddling over the top edges of both panels when said panels are aligned with each other, said U-shaped channel member having a pair of opposite substantially parallel sidewalls and at least one of said sidewalls being provided with an integral outwardly extending flange portion disposed substantially at right angle thereto, and means co-operating with one of said sidewalls for fitting said U-shaped channel member over panels of various thickness, said means comprising a rail member having a pair of opposed exterior side surfaces, said rail member being slidable over the flanged edge of one of the sidewalls and having a longitudinal slot for mounting over the flanged edge of said sidewall, said slot being disposed at unequal distance from each of said side surfaces.

2. The latch of claim 1 wherein said channel member has an interior surface coated with an anti-friction material.

3. A latch for a multi-panel door comprising at least a pair of juxtaposed aligned panels when said door is closed, said latch comprising a U-shaped channel member slidably disposed over the top edge of one of the panels forming said door and slidable to a position straddling over the top edges of both panels when said panels are aligned with each other, said U-shaped channel member having a pair of substantially parallel sidewalls and means co-operating with one of said sidewalls for fitting said U-shaped channel member over panels of various thicknesses, said means comprising a rail member having a pair of opposed exterior side surfaces, said rail member being slidable over an edge of one of said sidewalls and having a longitudinal slot for mounting over said edge of said sidewall, said slot being disposed at unequal distance from each of said side surfaces.

4. The latch of claim 3 wherein said channel member has an interior surface coated with an anti-friction material.

* * * * *